US005162698A

United States Patent [19]

Kato et al.

[11] Patent Number: 5,162,698

[45] Date of Patent: Nov. 10, 1992

[54] CASCADED RELATIVISTIC MAGNETRON

[75] Inventors: Keith Kato, Rancho Cucamonga; James Weatherall, Upland, both of Calif.

[73] Assignee: General Dynamics Corporation Air Defense Systems Div., Pomona, Calif.

[21] Appl. No.: 632,204

[22] Filed: Dec. 21, 1990

[51] Int. Cl.[5] ..... H01J 23/05; H01J 25/50

[52] U.S. Cl. ..... 315/39.51; 315/39.53; 331/86; 331/50; 313/346 R; 313/446

[58] Field of Search ..... 315/39.51, 39.53, 39.63, 315/39.67, 39.75, 4, 5; 331/5, 50, 86; 313/336, 346 R, 310, 311, 446

[56] References Cited

U.S. PATENT DOCUMENTS

| | | | |
|---|---|---|---|
| 2,496,500 | 2/1950 | Spencer | 315/39.51 |
| 3,273,074 | 9/1966 | Sobotka | 331/50 |
| 3,312,859 | 4/1967 | Wilbur et al. | 315/39.3 X |
| 3,508,110 | 4/1970 | Farney | 315/39.51 X |
| 3,982,152 | 9/1976 | Smith | 331/86 X |
| 4,053,850 | 11/1977 | Farney et al. | 331/91 |
| 4,100,458 | 7/1978 | Pickering et al. | 315/39 |
| 4,145,635 | 3/1979 | Tuck | 315/5.39 |
| 4,200,821 | 4/1980 | Bekefi et al. | 315/39.51 |
| 4,288,721 | 9/1981 | Dodonov | 315/39.51 |
| 4,310,786 | 1/1982 | Kumpfer et al. | 315/39.51 |
| 4,348,649 | 9/1982 | Lohrmann | 331/96 |
| 4,465,953 | 8/1984 | Bekefi | 315/39.71 |
| 4,480,210 | 10/1984 | Preist et al. | 315/4 |
| 4,518,932 | 5/1985 | Pickering | 331/90 |
| 4,527,091 | 7/1985 | Preist | 315/5 |
| 4,533,875 | 8/1985 | Lau et al. | 330/4 |
| 4,588,965 | 5/1986 | Cook | 331/91 |
| 4,629,938 | 12/1986 | Whitham | 315/5.41 |
| 4,677,342 | 6/1987 | MacMaster et al. | 315/39.3 |
| 4,705,989 | 11/1987 | Takada et al. | 315/39.51 |
| 4,721,885 | 1/1988 | Brodie | 313/576 |
| 4,757,269 | 7/1988 | Friedman et al. | 330/47 |
| 4,763,043 | 8/1988 | MacMaster et al. | 315/5.12 |

*Primary Examiner*—Eugene R. LaRoche
*Assistant Examiner*—Benny T. Lee
*Attorney, Agent, or Firm*—Leo R. Carroll

[57] ABSTRACT

A cascaded magnetron device has an elongate cathode shank extending along its axis and a series of tubular anode elements placed end to end in a linear cascade surrounding the cathode shank along at least part of its length. Each adjacent pair of anode elements is separated by a conductive, annular pin down disc, and the cathode shank has a series of spaced bands of field emitting material separated by non-emitting regions, each band being located within a respective one of the anode elements and spaced inwardly from the ends of that element. Suitable power inputs and magnetic field generators are provided for generating electron emission and oscillation in the interaction zone between each emitting band and the anode element surrounding that band, and suitable extraction devices are provided for extracting power from each of the interaction zones, the arrangement producing phase-locking of the cascaded magnetron bodies.

6 Claims, 2 Drawing Sheets

CASCADED RELATIVISTIC MAGNETRON

CROSS-REFERENCES TO RELATED APPLICATION

This application is related to a co-pending application Ser. No. 07/602,549 for "Single Body Relativistic Magnetron" by the same applicants, filed Dec. 21, 1990.

BACKGROUND OF THE INVENTION

1. Field of the Invention

This invention relates generally to cold or field emission cathode relativistic magnetron devices.

2. Description of Related Art

The conventional magnetron is a well-known and very efficient source of low frequency microwaves. Its operating principles have been known since at least 1921, and the first pulsed resonant cavity magnetron (3 GHz), built by the British in 1940, can be considered the germinal point of modern microwave radar. Today, magnetrons can be found in every home possessing a microwave oven.

A typical single body magnetron is a coaxial vacuum device consisting of an external cylindrical anode (the positive electrode, which attracts electrons) and an internal, coaxial cylindrical cathode (the negative electrode, which emits electrons). In many designs, rectangular resonator cavities are cut into the anode block in a gear tooth pattern. During operation, a constant axial (perpendicular to the plane of the page) magnetic field fills the vacuum annulus, and an electric potential is placed between the anode and cathode. The number and shape of the resonator cavities, and the dimensions of the anode and cathode are arbitrary design features which determine the magnetron's frequency and operating characteristics.

Deficiencies in the present high power microwave magnetron technology are evident, with the most serious being the inability to generate pulse lengths of a microsecond or greater. This is particularly critical for increasing the energy per pulse being produced. A magnetron producing 500 MW for 3 $\mu$s would represent an order-of-magnitude increase in energy per pulse over the present experimental devices, and is greatly desired for practical applications.

Attempts have been made in the past to achieve higher output power by phase locking separate magnetrons. However, magnetrons are historically notorious for their inability to be phase locked. Efforts are being made to achieve injection phase locking of several distinct or separate magnetron bodies having a common master input signal. Efforts have also been made to achieve bootstrap phase locking of several distinct magnetron bodies arranged side by side in a hexagonal array by energizing them simultaneously without a common master input signal, but with pair-wise waveguide connections between the magnetrons. The communication between the magnetron bodies via the waveguides is tenuous at best in this arrangement, and neither approach can be considered a significant solution to the phase-locking problem.

SUMMARY OF THE INVENTION

It is an object of this invention to provide an improved magnetron design in which several relativistic magnetrons can be bootstrap phase locked to achieve higher output power.

According to the present invention, a relativistic magnetron device is provided which comprises an elongate, cathode shank extending along the axis of the device and a plurality of anodes placed end to end in a cascade with an annular pin down disc separating each adjacent pair of anodes, the anodes surrounding the cathode shank along at least part of its length, and the cathode shank having a series of spaced electron emitting bands of field emitting material separated by non-emitting regions, each band of emitting material being located within a respective one of the anodes. A suitable power input or driver for applying an electric field between each anode and the cathode is provided, the driver impedance being matched to the total impedance of the cascaded magnetron units, and a suitable magnetic field generator is provided for creating an axial magnetic field of predetermined strength in the annular cavity between each anode and the enclosed emitting band of the cathode.

This arrangement produces a multi-body cascade of magnetrons which are phase-locked and in which the output powers can be coherently added.

The pin-down discs are used to pin down the nodes of any axial mode generated by a magnetron unit. In this way, if the magnetrons are properly started up in the $\pi$-mode, they would behave as autonomous single body magnetrons in their lowest axial mode. However, because they share a common annular volume, communication exists and the magnetrons should phase lock together.

Preferably, a symmetrical current feed is provided to both ends of the cathode shank, using dual, synchronized pulsed power units or dual transmission lines from a single power unit. In either case, the total impedance of the cascaded magnetron and the drivers or drive units must be matched. For example, if each magnetron has an impedance of Z ohms, then N bodies in cascade would exhibit an impedance of Z/N ohms. The two pulse forming units driving each end of the cascade should each have an impedance of 2Z/N ohms.

In a preferred embodiment of the invention, each anode has an even number of resonator cavities facing the cathode, and alternate cavities are coupled to suitable microwave extraction devices such as waveguides or the like to extract energy from the cavities. The magnetic field generator preferably comprises a series of electromagnets or permanent magnets placed in the gaps between the output waveguides of adjacent anodes and outside the outermost anodes at each end of the cascade.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
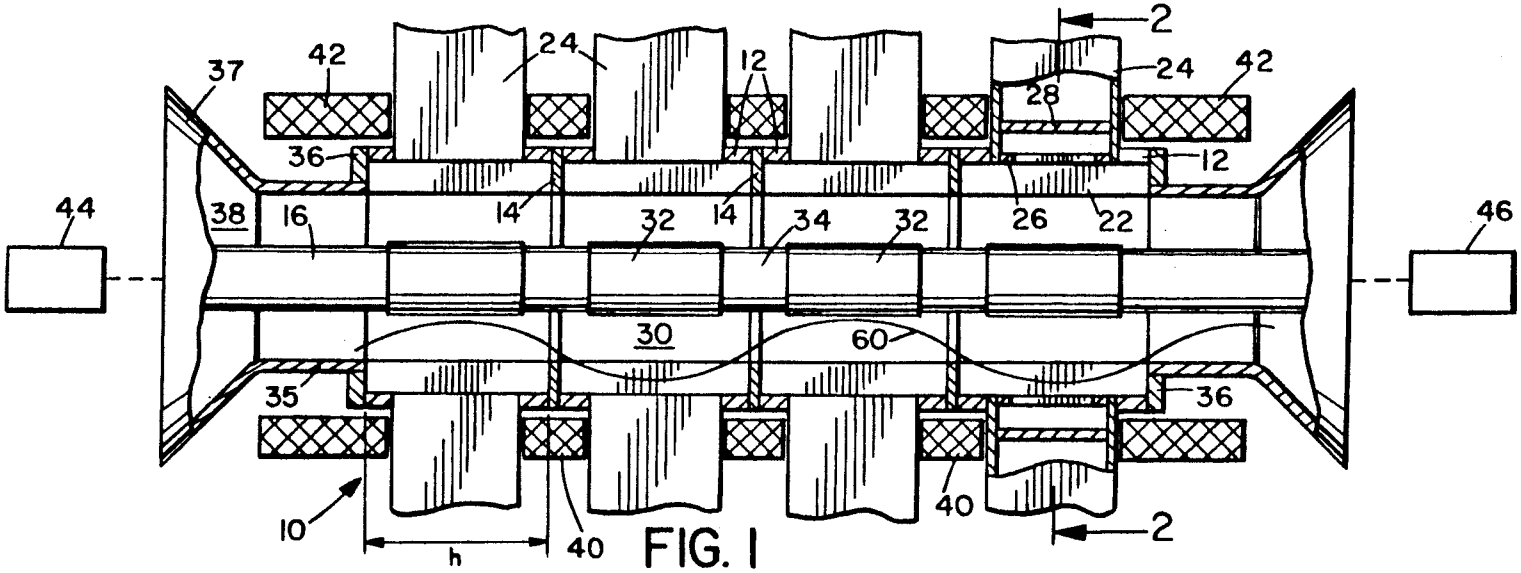
FIG. 1 is a side elevation view, with portions cut away, of the cascaded magnetron structure according to a preferred embodiment of the invention.
Figure 4:
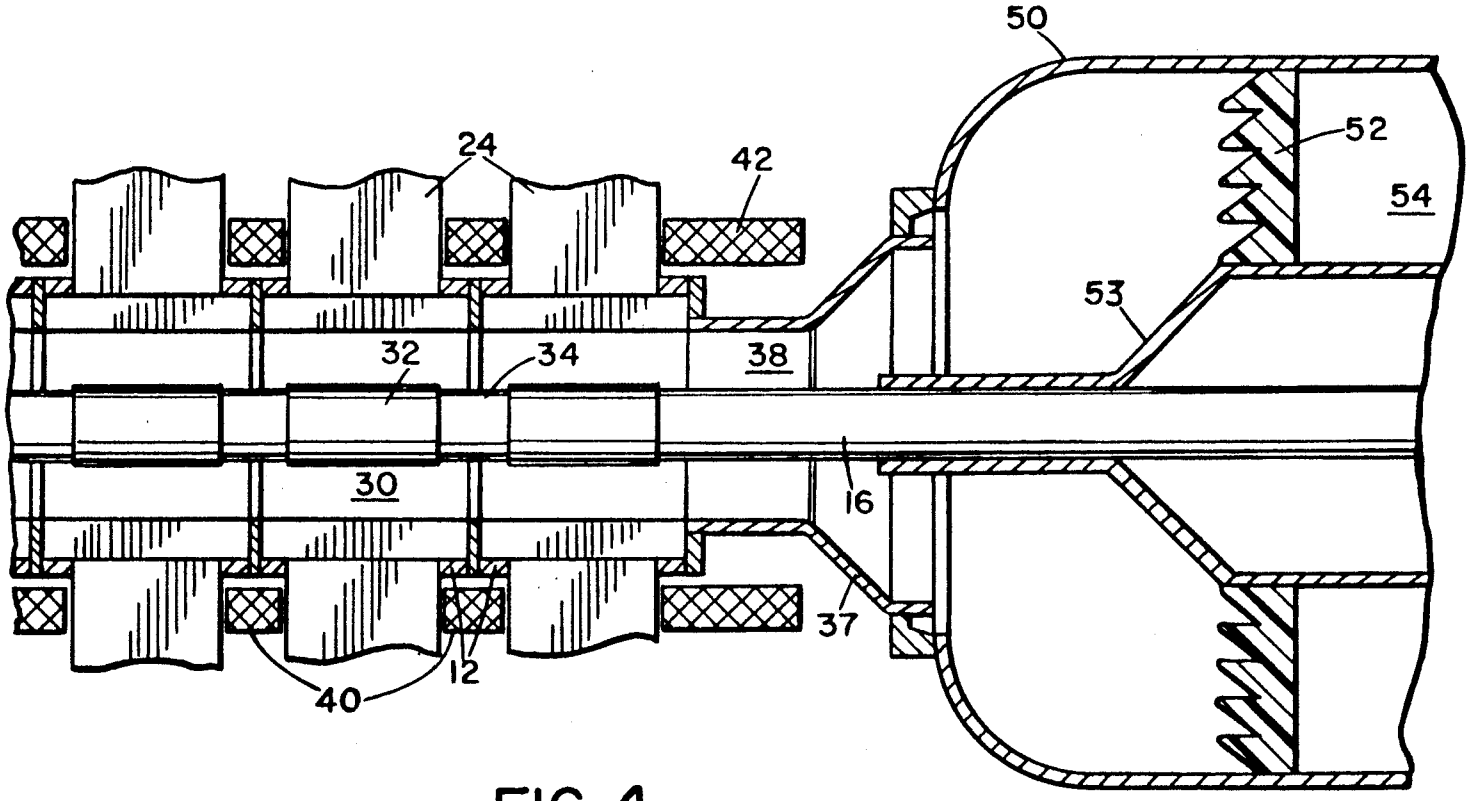
FIG. 4 is similar to a portion of FIG. 1, with end support and connection structure added.

The drawings illustrate a cascaded relativistic magnetron device 10 according to a preferred embodiment of the present invention. The device basically comprises a plurality of separate tubular anode elements 12 arranged end to end in a linear cascade with an annular, conductive pin down disc 14 separating each adjacent pair of anode elements 12, as illustrated in FIG. 1. A cathode shank 16 extends co-axially within the anode elements along the length of the device, with opposite ends of the cathode shank projecting outwardly from the outermost anode elements and mounted in a suitable end supporting structure, for example as illustrated in FIG. 4.

Figure 2:
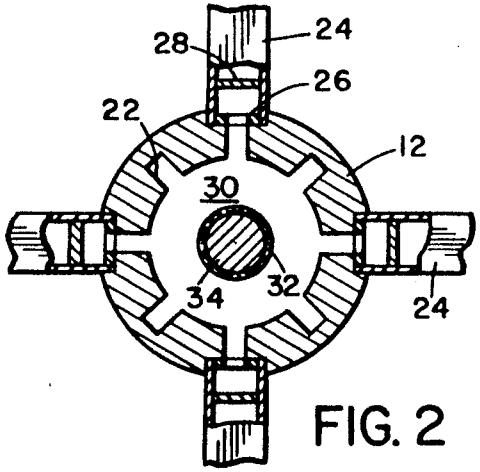
FIG. 2 is a sectional view taken on line 2—2 of FIG. 1.

Each anode element of the cascade has a series of identical resonator cavities 22 cut into its inner surface (see FIG. 2). Preferably, each anode element has the same number of resonator cavities. In the embodiment illustrated, the anode elements each have 8 cavities, but a greater or lesser number may be used in alternative embodiments. If the number of resonator vanes is an integer power of two, an HPM (high power microwave) phased array antenna may be conveniently driven by the cascade with a minimum of splitters and collateral waveguide plumbing. Alternative cavities of each anode element are each cut through to the outside of the anode and coupled to an external load via separate extraction devices, which in the preferred embodiment illustrated comprise output waveguides 24 (see FIG. 2). A suitable quarter wave transformer coupling iris 26 connects the respective alternate cavity to its respective waveguide 24, and the waveguide is sealed off to maintain vacuum integrity by means of a suitable vacuum tight dielectric window 28. The magnetron is preferably designed to operate in the S- band (2.60 to 3.95 GHz), in which case the waveguides may comprise standard WR-284 or S-band waveguides, and each transformer iris is used to match the impedance between the magnetron output vanes or cavities and the waveguide. However, the magnetron may alternatively be designed for operation at other frequencies.

Annular cavities 30 are defined between each anode element and the area of the cathode shank within that cavity. The cathode is of an anodized, non-emitting material and has spaced bands or layers 32 of emitting material applied to predetermined regions of its surface, one of the bands being located within each of the interaction cavities 30 and spaced inwardly from the outermost ends of the cavity. Thus, each emitting band 32 is separated from the emitting band in the next adjacent cavity by a non-emitting gap 34. This, in addition to the separation discs, physically separates the interaction area or chamber in each magnetron cavity from the next adjacent magnetron cavity in the cascade. In the preferred embodiment of the invention, the emitting band is of a cathode material having a non-smooth, fibrous or fuzzy surface texture which is bonded to the cathode shank in the desired areas. One suitable material is a graphite felt cathode material as produced by Quantum Diagnostics, Ltd. of Hauppage, New York. This material will ignite at relatively low electric field stresses and has a relatively high current density, improving operation efficiency of the magnetron, and also has a relatively long shot lifetime of several hundreds of shots or ignitions before it must be replaced. By spacing the emitting inwardly from the ends of the adjacent magnetron cavities, the cavities can be linearly assembled and undesirable end effects can be reduced or avoided.

The projecting end portions of the cathode shank are surrounded by co-axial waveguide members 35 of conductive material which project outwardly from the outer end of each of the outermost anode member. The members 35 have annular projecting rings or flanges 36 at their innermost ends which form end caps for the outermost ends of the resonator cavities of the outermost two anode elements, as best seen in FIG. 1. The waveguide members 35 each have a flared outer end portion 37 which is secured in the end supporting structure, as described below in connection with FIG. 4. The annular waveguide endspaces 38 defined between the projecting ends of the cathode shank and the surrounding waveguide members are designed to be in cut-off at the operating mode of the magnetron. In a preferred embodiment of the invention, the waveguide members are designed to be in cut-off at the desirable $\pi$-mode. In a magnetron, various resonant modes occur, and the magnetron should be designed such that only one mode of oscillation, or resonant frequency, is dominant. Preferably, this should be the $\pi$-mode since this provides the most stable operation. Thus, in the illustrated embodiment, other modes having frequencies greater than cut-off will escape the magnetron cavity by propagating into the end spaces. Any modes which cannot propagate into the end spaces will be trapped in the magnetron cavity and the magnetron resonates at this frequency. The end spaces are sealed off to maintain vacuum integrity within the magnetron, by means of suitable end structures, for example as illustrated in FIG. 4.

The desired axial magnetic field is provided in the magnetron cavities via permanent magnets or electromagnets 40 which are located in the spaces between the output waveguides of adjacent magnetron elements and larger magnets 42 located outside the waveguides at the outermost ends of the magnetron cascade. The magnetic field is designed to be constant in the annular interaction spaces 30 between each anide element and the respective cathode emitting band within that anode element.

A suitable electric field is applied between the anode elements and cathode in order to induce electron emission. The magnitude of the electric and magnetic fields required for magnetron operation can be estimated theoretically in a similar manner to the single body magnetron as explained in our co-pending application Ser. No. 07/602,459 entitled "Single Body Relativistic Magnetron", filed Dec. 24, 1990. In the preferred embodiment of the invention illustrated, the anode elements are connected to ground while a symmetrical current input is applied at opposite ends of the cathode shank via input leads connected to respective synchronized pulsed power units or drivers 44, 46, as illustrated schematically in FIG. 1. The impedance of units 44, 46 is matched to that of the cascaded magnetron. Thus, where each element of the cascade has an impedance of Z ohms, and there are N magnetron elements in the cascade, the total impedance will be Z/N, and the two pulse forming elements driving each end of the cascade should each have an impedance of 2Z/N.

Preferably, the mounting structure at opposite ends of the magnetron includes a radial voltage grading structure for reducing the risk of arcing or voltage breakdown, as best illustrated in FIG. 4. This structure is the same as that described in our co-pending application Ser. No. 07/602,549 referred to above entitled "Single Body Relativistic Magnetron", and basically comprises an outer wall or sleeve 50 of metallic, conductive material, secured to the outer end of each of the endspace waveguide members and surrounding the cathode shank, and annular ring 52 of plastic material mounted on a flared portion 53 at the end of the cathode shank and extending between the cathode shank and the outer wall. The ring 52 has a saw tooth pattern on its inner face, and separates the magnetron vacuum chamber from an oil chamber 54 located within the outer wall outside ring 52, and sealed by a suitable end cap (not illustrated).

The dimensions of each of the magnetron elements in the cascade will be selected according to the same criteria as for the single body magnetron described in our co-pending application Ser. No. 07/602,549 referred to above. The following description represents the design considerations for such a single body relativistic magnetron which would be suitable as one element of the cascade structure described above. Magnetron operation begins when an electric potential is applied between the electrodes. The magnetic field acts to insulate the electrodes by confining the electrons to the annular region inside the magnetron. The circular motion of electrons in the crossed electric and magnetic fields stimulates electromagnetic oscillations in the cavity, particularly when the velocity of the electrons matches the phase velocity of one of the normal mode components. The radiation thus formed is coupled via the waveguides from the magnetron cavity. The resonant frequencies of a magnetron can be calculated by the standard admittance matching technique, in which the RF admittance of the interaction space between the anode and cathode is set equal to the RF admittance of the resonator vanes at their common interface (see, e.g., *Microwave Magnetrons* edited by G. B. Collins, MIT Radiation Laboratory Series Vol. 6 (McGraw Hill, New York, 1948), for standard magnetron design theory.

Figure 3:
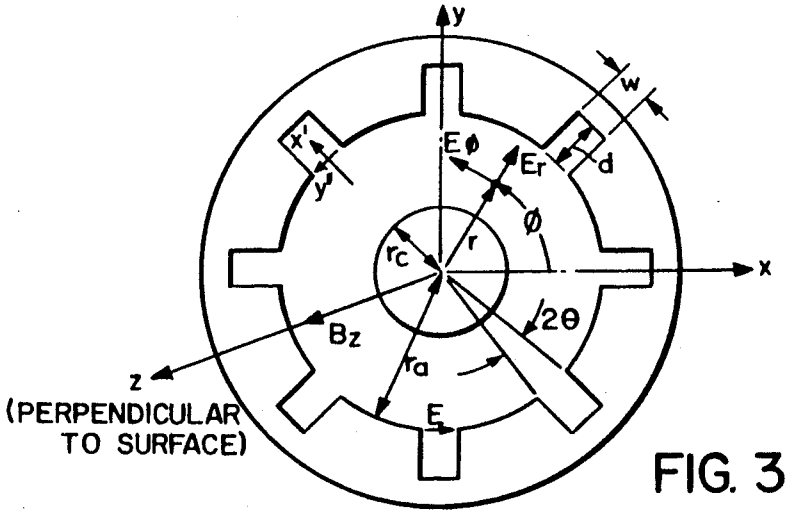
FIG. 3 is a schematic cross-section showing the electromagnetic nomenclature.

The cavity fields can be derived by ignoring the presence of electron space charge. Assuming a standard $(r,\phi,z)$ cylindrical coordinate geometry of infinite length, there r is the radial coordinate in a standard cylindrical coordinate system $\phi$ is the azimuthal coordinate, and z is the axial coordinate, the fields will have nonzero components $E_r$, $E_\phi$, and $B_z$, where $E_r$ is the radial electric field, $E_\phi$ is the azimuthal electric field, and $B_Z$ is the axial magnetic field, as illustrated in FIG. 3. Boundary conditions require $E_{100}=0$ on the cathode, and zero everywhere on the anode block except where there are gaps, when the field is allowed to have a uniform amplitude E. The field varies in phase from gap space to gap space, with a phase difference between adjacent gaps of $2\pi n/N$ radians, n and N being integers. N is the total number of vane gaps, and in the nomenclature of magnetron mode identification, n is the mode number. As shown in FIG. 3, d is the depth of a cavity while w is the width. In addition $r_a$ and $r_c$ are the radii of the anode and cathode respectively. $2\theta$ is the angle subtended by the gap space between adjacent anode segments, and h is the magnetron height.

A standard technique in boundary value problems is to use a basis set of orthogonal functions which satisfy the wave equation. In this case, a combination of Bessel and Neumann functions forms a useful basis set $Z_\gamma$, defined as:

$$Z_\gamma(kr) = J_\gamma(kr) - \frac{J_\gamma'(kr_c)}{Y_\gamma'(kr_c)} Y_\gamma(kr). \tag{1}$$

The wavenumber $k=\omega/c$ where $\omega$ is the electromagnetic mode frequency and c is the speed of light. $J_\gamma$ is a Bessel function of the first kind, order $\gamma$, and $Y_\gamma$ is a Bessel function of the second kind (Neumann function), order $\gamma$, $J'_\gamma$ is the derivative of $J_\gamma$ with respect to its argument, and $Y'_\gamma$ is the derivative of $Y_\gamma$ with respect to argument. For each mode number n, the angular harmonics can be combined to satisfy the imposed boundary conditions (see Collins, supra, p. 65):

$$E_\phi(r,\phi) = \frac{EN\Theta}{\pi} \sum_{m=-\infty}^{\infty} \frac{\sin(\gamma\Theta)}{\gamma\Theta} \frac{Z_\gamma'(kr)}{Z_\gamma'(kr_a)} \exp(i\omega t + i\gamma\phi), \tag{2}$$

$$E_r(r,\phi) = -i\frac{EN\Theta}{\pi kr} \sum_{m=-\infty}^{\infty} \gamma \frac{\sin(\gamma\Theta)}{\gamma\Theta} \frac{Z_\gamma(kr)}{Z_\gamma'(kr_a)} \exp(i\omega t + i\gamma\phi),$$

$$B_z(r,\phi) = -i\sqrt{\epsilon\mu}\frac{EN\Theta}{\pi} \sum_{m=-\infty}^{\infty} \frac{\sin(\gamma\Theta)}{\gamma\Theta} \frac{Z_\gamma(kr)}{Z_\gamma'(kr_a)} \exp(i\omega t + i\gamma\phi).$$

In the summation, the index $\gamma=n+mN$. $\Theta$ is the half angle subtended by the gap space between segments of the anode block. $\epsilon$ is the permitivity of free and $\mu$ is the magnetic permeability of free space. t is the time coordinate, and i is the square root of $-1$. E is the electric field in the anode gap.

The solution is not complete because the fields in the side cavities must be matched to the interaction region fields at the gap space. The fields in the vanes are:

$$E_y = E\frac{\sin[k(d-x')]}{\sin(kd)} \tag{3}$$

$$H_z = -iE\sqrt{\frac{\epsilon}{\mu}} \frac{\cos[k(d-x')]}{\sin(kd)}.$$

The vane coordinates are such that z is along the magnetron axis, and x' measures depth into the vane. The orthogonal axis y' is aligned with the direction of $\phi$. $H_z$ is the axial magnetic intensity.

As one might expect, the fields will match only at particular frequencies which are resonances of the system. The frequencies are found by setting the RF admittance of the interaction space equal to the RF admittance of the vanes at their common interface. The RF admittance is expressed as a spatial average of the Poynting flux, giving the following dispersion relation:

$$i\sqrt{\frac{\epsilon}{\mu}} \frac{Nh}{2\pi r_a} \sum_{m=-\infty}^{\infty} \left[\frac{\sin(\gamma\Theta)}{\gamma\Theta}\right]^2 \frac{Z_\gamma(kr_a)}{Z_\gamma'(kr_a)} = -i\frac{h}{w}\sqrt{\frac{\epsilon}{\mu}}\cot(kd). \tag{4}$$

The height of an individual magnetron in the cascade is denoted by h. This transcendental equation for the frequency is usually solved graphically by plotting both the admittances of the interaction space and the vanes (the left and right hands sides of the dispersion equation) as a function of frequency; points where the lines intersect give $\omega$. There are an infinite number of resonances for each mode number n, but only the lowest cnes will be important.

In one particular example, each anode element had a length of 10 cm while the length of the emitting band within the anode element was 8 cm, so that it was spaced inwardly 1 cm from each end of the anode element. The length of each anode element must be greater than the width of the waveguide used, so that the space is sufficient to allow waveguide extraction from each of the magnetron bodies in the cascade. However, the anode elements are still short enough to avoid higher order axial mode competition in the $\pi$-mode. The cathode shank had a radius of 1.75 cm while the anode inner surface had a radius of 4.61 cm, resulting in an anode to cathode separation of 2.86 cm. The anode had 8 vanes or resonator cavities, and each cavity had a depth of 1.75 cm and a width of 1.34 cm. With this arrangement, a relatively large anode to cathode gap is provided, to increase the output pulse length, and at the same time the cathode radius is relatively large to provide a large emitting surface area. At the same time, the coaxial endspace waveguides, which are of the same radius as the anode inner surface, will be in cut-off at the $\pi$-mode frequency. Thus, frequencies higher than the $\pi$-mode are allowed to leak out of the end spaces, further establishing the dominance of the $\pi$-mode.

The angles subtended by the resonator cavities and the gap between adjacent cavities are approximately equal with this design.

Each magnetron has its own characteristic scaling parameters which are functions of the magnetron dimensions and operating frequency (see G. B. Collins, ed., *Microwave Magnetrons,* MIT Radiation Laboratory Series Vol. 6, McGraw-hill, New York, 1948, page 416). A single chamber of the cascaded magnetron illustrated in the drawings conforms to a well-established magnetron known as the 2J32 magnetron, which has the same number of vanes and ratio of anode to cathode size. and vane gap to anode block spacing. Thus, this can be used to provide a practical operating point for the described magnetron, using FIG. 11, page 420 of Collins, supra.

An example of the single body design described in our copending application referred to above was tested and demonstrated very clean and stable $\pi$-mode operation at 3.148 GHz, with an estimated power conversion efficiency of 35%. This magnetron produced a power output of 125 MW at 680 kV in testing, and had a typical pulse length of 80 ns. In the cascaded design, if the magnetrons are properly started up in the $\pi$-mode, they will behave as autonomous single body magnetrons in their lowest axial mode, but because they all share a common annular volume, communication exists and they should phase lock together. Thus, their output powers can be coherently added. With this arrangement, a four body cascade can potentially produce at least 1 GW of RF power for microsecond (1 kJ per pulse) into sixteen waveguides, with a power conversion efficiency estimated to be at least 35%. This combination of peak power, pulse duration, and efficiency has not previously been offered by any high power microwave source.

The cascaded magnetron differs from simply lengthening the axial dimension of a single body magnetron, which would result in competition between axial modes, with each mode absorbing its portion of the injected electrical power, and reduction in efficiency. In the cascaded magnetron, the pin down discs between adjacent cavities enforce the operation of the cascade at the lowest per-body axial mode, by pinning down the nodes of any axial mode. If the magnetrons are started up properly in the $\pi$-mode, they will behave as autonomous single body magnetrons in their lowest axial mode. This forces the axial mode 60 into the lowest operating mode of one standing half wave per body of the cascade, as illustrated at 60 in FIG. 1. However, because communication exists between the annular cavities, the magnetron bodies should phase-lock together. The cathode emitting areas are spaced inwardly from the ends of the anode and thus from the pin-down discs, reducing or eliminating the risk of arcing to the pin-down discs.

This arrangement permits intimate communication between different magnetron bodies linked in a cascade, since the cascade is intrinsically one body composed of many linked chambers. Thus, phase locking of several bodies and corresponding higher total output power for the same input can be achieved with this design.

The relatively low operating voltage (around 600 kV), high impedance, and high efficiency of this magnetron design permits the use of militarily compact, transportable and rugged modulators as the power input. Other high power microwave sources typically operate at voltages of the order of 1 MV, requiring larger enclosures to handle insulation and breakdown problems. They usually have much lower efficiency, of the order of 10% or less, with size and weight penalties on the modulator to achieve the same output power levels. Also, they typically require powerful magnets to operate. The magnetic fields required for their operation are typically greater than 1.5 T, so that permanent magnets cannot be used. The use of electromagnets to generate such fields requires the investment of significant energy, reducing the utility of such high power microwave sources.

In contrast, the cascaded magnetron can operate efficiently with relatively low operating voltages and magnetic field strengths, allowing the use of permanent magnets or electromagnets and reducing power consumption.

Although a preferred embodiment of this invention has been described above by way of example only, it will be understood by those skilled in the field that modifications may be made to the disclosed embodiment without departing from the scope of the invention, which is defined by the appended claims.

We claim:

1. A phase-locked, cascaded relativistic magnetron device, comprising:

an elongate cathode shank having a longitudinal axis extending along a central longitudinal axis of the device, the shank having opposite outer ends defining its length;

a plurality of spaced tubular cylindrical anode elements, each anode element having opposite ends and the anode elements being placed end to end lengthwise at spaced intervals along said central longitudinal axis in a cascade arrangement surrounding the cathode shank along at least part of its length with a respective gap between each adjacent pair of anode elements, each anode element defining a respective annular cavity between the cathode shank and a respective inner surface;

a series of annular discs of conductive material, a respective disc being located in the respective gap between a respective adjacent pair of anode elements and comprising means for pinning down axial mode oscillation nodes in the respective cavity defined by each anode element of said adjacent pair to form a cascade arrangement of separate magnetron units having opposite outermost ends at said ends of said anode element nearest said opposite outer ends of said shank, the cascade arrangement of separate magnetron units having a predetermined total impedance;

the cathode shank having a series of spaced emitting bands of field emitting cathode material separated by non-emitting regions, each emitting band being located within a respective one of the anode elements and being spaced inwardly from the ends of the respective anode element to create a series of spaced annular interaction zones between each emitting band and the opposing inner surface portion of the respective anode element;

generator means operatively coupled to each said annular cavity for generating an axial magnetic field of predetermined strength in said cavity;

input driver means operatively coupled to said device for supplying an electric field between each emitting band and said corresponding anode element, said driver means having an impedance matched t the total impedance of the cascaded arrangement of magnetron units; and extraction means operatively coupled to the spaced interaction zones for extracting energy from each interaction zone.

2. The device as claimed in claim 1, wherein each anode element has further disposed therein an even number of resonator cavities facing the cathode shank, and said extraction means comprises means for extracting power from alternate resonator cavities of each of the anode elements.

3. The device as claimed in claim 2, wherein said extraction means comprises a plurality of output waveguides, each waveguide being connected to a respective one of said alternate resonator cavities.

4. The device as claimed in claim 1, wherein said generating means comprises a plurality of annular permanent magnets surrounding said cascade arrangement at spaced intervals, a respective magnet being positioned at each outermost end of said cascade arrangement and magnets being located adjacent to the adjacent ends of each pair of anode elements.

5. The device as claimed in claim 1, including tubular waveguide members projecting co-axially from the outermost ends of said cascade arrangement, the anode elements having matching internal diameters, and the waveguide members each having an internal diameter equal to the respective internal diameters of said anode elements, the cathode shank projecting outwardly from the opposite ends of said cascade arrangement and into said waveguide members to define annular end spaces of predetermined dimensions of opposite ends of said cascade arrangement, said ends spaces comprising means for establishing a standing wave pattern at a predetermined operating frequency.

6. The device as claimed in claim 1, wherein said input driver means comprises symmetrical current input means operatively coupled to opposite ends of said cathode shank for feeding current symmetrically to both ends of the cathode shank.

* * * * *